United States Patent [19]

Kelly

[11] Patent Number: 5,011,452

[45] Date of Patent: Apr. 30, 1991

[54] BREATHABLE BRASSIERE WITH ADJUSTABLE DRAWSTRING

[76] Inventor: Toby Kelly, 702 Pepperridge Rd., Bloomington, Ind. 47401

[21] Appl. No.: 502,418

[22] Filed: Mar. 30, 1990

[51] Int. Cl.[5] ..... A41C 3/00; A41C 3/02

[52] U.S. Cl. ..... 450/69; 450/58

[58] Field of Search ..... 2/67, 73, 105, 106, 2/109, 110; 450/1, 23, 58.68, 69, 70, 77, 73, 79, 80, 82, 83, 85, 88

[56] References Cited

U.S. PATENT DOCUMENTS

| | | | |
|---|---|---|---|
| D. 270,774 | 10/1983 | Stern et al. | D2/24 |
| D. 270,775 | 10/1983 | Stern | D2/24 |
| D. 278,945 | 5/1985 | Stern | D2/24 |
| 1,306,595 | 6/1919 | Jerome | 2/110 |
| 1,317,621 | 9/1919 | Donaldson | 2/110 X |
| 1,980,767 | 11/1934 | Snader | 450/70 |
| 2,266,518 | 12/1941 | Sarge | 2/73 |
| 2,400,499 | 5/1946 | Gerace | 450/68 |
| 2,484,467 | 10/1949 | Schacht | 450/69 |
| 2,585,567 | 2/1952 | Marin | 2/73 X |
| 2,760,199 | 8/1956 | Champagne | 450/58 X |
| 2,782,418 | 2/1957 | Garson | 450/88 X |
| 2,882,905 | 4/1959 | Barg | 450/58 |
| 2,887,688 | 5/1959 | Kyle | 2/73 X |
| 3,311,112 | 3/1967 | Murray | 450/82 X |
| 3,422,818 | 1/1969 | Erteszek | 450/30 |
| 4,289,137 | 9/1981 | Dell et al. | 128/482 |
| 4,294,257 | 10/1981 | Renhofer | 2/67 X |
| 4,444,191 | 4/1984 | Harned | 2/45 X |
| 4,538,614 | 9/1985 | Henderson | 450/70 |
| 4,583,544 | 4/1986 | Flannagan | 2/67 X |
| 4,741,719 | 5/1988 | Wirth | 450/30 |
| 4,804,351 | 2/1989 | Raml et al. | 450/58 |
| 4,816,005 | 3/1989 | Braaten | 450/58 |
| 4,875,236 | 10/1989 | Boynton | 2/67 |
| 4,917,651 | 4/1990 | Rainville | 450/58 |

FOREIGN PATENT DOCUMENTS

| | | | |
|---|---|---|---|
| 0021305 | 4/1930 | Australia | 450/69 |
| 0292452 | 6/1916 | Fed. Rep. of Germany | 450/69 |
| 0899693 | 6/1945 | France | 450/58 |
| 0984687 | 7/1951 | France | 450/69 |
| 1014291 | 8/1952 | France | 450/69 |
| 1157962 | 6/1958 | France | 450/88 |
| 0204642 | 10/1923 | United Kingdom | 450/69 |

*Primary Examiner*—Werner H. Schroeder
*Assistant Examiner*—Jeanette E. Chapman
*Attorney, Agent, or Firm*—Marks Murase & White

[57] ABSTRACT

A brassiere which is particularly suitable for use during sporting activities or for persons in postsurgical rehabilitation. The bra has a front panel of non-stretch material, such as a cotton/polyester blend, and a back panel of stretch material, such as a nylon/lycra blend. A drawstring is provided through the front panel to allow the wearer to mold the front panel to provide the desired degree of breast support and comfort. Straps having one end connected to the front panel and another end connected to the back panel may be provided. The straps are preferably formed of a non-stretch material and include a length-adjustment device. Either the front panel or the back panel may be divided into two portions to allow the wearer to put on the brassiere without raising their arms above their head. The two portions of the panel which are divided can be fastened by a variety of known fastening means.

20 Claims, 4 Drawing Sheets

BREATHABLE BRASSIERE WITH ADJUSTABLE DRAWSTRING

BACKGROUND OF THE INVENTION

The present invention relates to an adjustable brassiere (bra) suitable for everyday use and particularly suited for use by women engaged in sports or other physical activities and for women during post-operative recovery.

Conventional brassieres typically are formed of elastic materials and include, among other things, shaped cups to form and shape the breasts. While this is sometimes desirable from an appearance standpoint, such a construction does not provide sufficient support for women engaged in sporting activities and the like. Most conventional bras are not adjustable to the extent needed to allow the wearer to optimize support and comfort. Further, the elastic bands in conventional bras rub and chafe the skin during use and buttons, snaps, hooks and other hardware, or seams, provided in conventional bras can irritate the skin and are extremely uncomfortable for those engaged in sporting activities and the like. Additionally, bras which are not adjustable and have elastic or stretchable elements in the front portion can be extremely uncomfortable for women recovering from breast surgery.

As a result of the increasing involvement of women in activities such as competitive sports, jogging, horseback riding and aerobics, there has been increased awareness of the aforementioned drawbacks of conventional bras. Several attempts have been made to provide bras suitable for use by women engaged in sporting activities.

One such sports bra is described in U.S. Pat. No. 4,818,005 to Braaten. This patent discloses a brassier constructed of stretchable material reinforced by "darts" within the material and elastic bands. The front panel is divided into two portions which can be connected by a zipper or the like. Although such a construction provides increased support, it is not readily adjustable and has several other drawbacks. For instance, it is difficult to manufacture.

Other sports bra constructions are disclosed in U.S. Pat. No. 4,741,719 to Wirth; U.S. Pat. No. 4,583,544 to Flanagan et al.; U.S. Pat. No. 4,444,191 to Harned; and U.S. Pat. No. 4,289,137 to Dell et al. Bra designs which include strap length adjustment means include U.S. Design Pat. Nos. D 278,945; D 270,775; and D 270,774 all to Stern, et al.

Generally, known bra constructions suffer from a number of drawbacks when used as sports bras or post surgery rehabilitative bras. Foremost among these is the lack of real adjustability. Additionally, sports bras manufactured of materials, such as , which do not allow adequate breathability, are uncomfortable. Most known sports bras are too tight to be comfortable for extended periods of time. On the other hand, bras constructed entirely of stretch fabric are heavy and generally uncomfortable and can irritate the skin because moisture trapped against the skin is not allowed to dry quickly. Additionally, because of the materials typically used, presently available sports bras are generally unattractive and unfashionable.

Thus, there is still a need for a sports bra which provides adequate support without sacrificing comfort, breathability and appearance. There is also a need for a bra which can be comfortably worn by women recovering from breast surgery.

SUMMARY OF THE INVENTION

The brassiere of the present invention overcomes the aforementioned problems of known sports bras and rehabilitation bras. Specifically, the bra of the present invention includes a front panel constructed of non-stretch material, a continuous back panel constructed of stretch material and having ends connected to the ends of the front panel and at least one drawstring. The drawstring is provided in the front panel such that two drawstring ends extend out of the front panel. With this construction, the front panel can be tightened to achieve the desired support and comfort by pulling the ends of the drawstring. Once the desired support and comfort are achieved, the two ends of the drawstring can be tied to maintain the front panel in the tightened position. The knotted drawstring ends can be tucked under the front panel or left out. Thus, the bra is fully adjustable.

The bra can include two straps, each of which has an end connected to the front panel and an end connected to the back panel. The straps may be straight or criss-crossed, as is known in the art. Preferably, the straps are formed of non-stretch material and a length-adjustment device of the type known in the prior art is provided in each strap.

While any known materials can be used, superior results are believed to be obtained from the use of a cotton/polyester blend non-stretch material and a nylon/lycra blend stretch material. More specifically, excellent results have been achieved using a 50/50 blend of cotton/polyester as the non-stretch material and using an 85 percent nylon/15 percent lycra blend for the stretch material.

The dimensions of the front and back panels can be changed to accommodate various needs. For instance, one of the panels may be significantly shorter (head to toe direction) or narrower (arm to arm direction) so as to alter the overall elasticity and feel of the bra. However, advantageous results have been obtained using a front and back panel which are virtually the same size, or at least have similar heights.

To accommodate uses, such as postsurgical rehabilitative uses, in which it is impractical to pull the bra over the head and arms, one of the panels, preferably the front panel, can be divided into two portions which can be connected to one another by a fastening means. Any known fastening means such as hookand-eye fasteners, buttons, snap fasteners or velcro strips may be used.

When the front panel is split, it is preferable to use separate drawstrings on each portion of the front panel. Otherwise, it is generally preferable to use a single drawstring, which is received in the front panel such that the ends of the drawstring extend from a common edge of the front panel. This can be accomplished by providing two drawstring sleeves in the front panel and passing the drawstring, or in the case of separate drawstrings, each drawstring, through the drawstring sleeves.

Because of the wide range of adjustability it offers, the brassier construction of the present invention provides sufficient support for women engaged in sporting activities without sacrificing comfort, appearance or breathability. The bra is also ideal for use during post-surgical rehabilitation. Because of this outstanding combination of features, the bra is suitable for all day use, not just use during sporting activities. In fact, the bra of the present invention can be constructed of attractive materials and used as a fashionable piece worn as a top for any occasion.

Several embodiments of the present invention are described below in connection with the drawings in which the same numeral is used to designate similar elements.

DETAILED DESCRIPTION

Figure 1B:
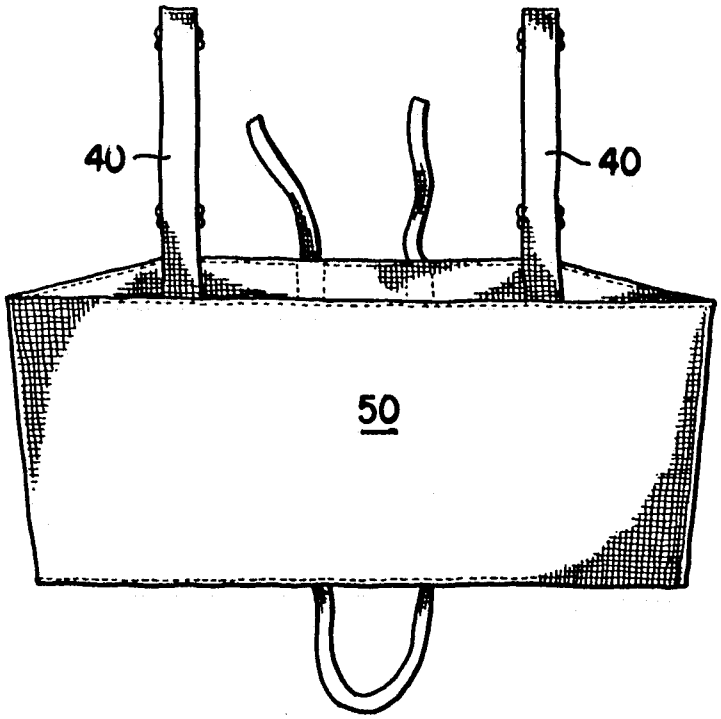
FIG. 1B is a back view of the bra of FIG. 1A.
Figure 1A:
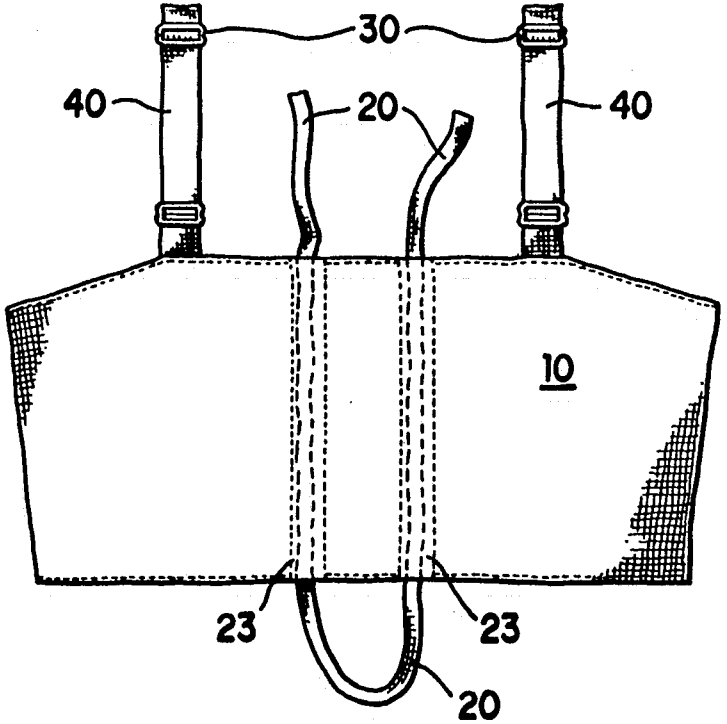
FIG. 1A is a front view of a first embodiment of the bra of the present invention.
Figure 3:
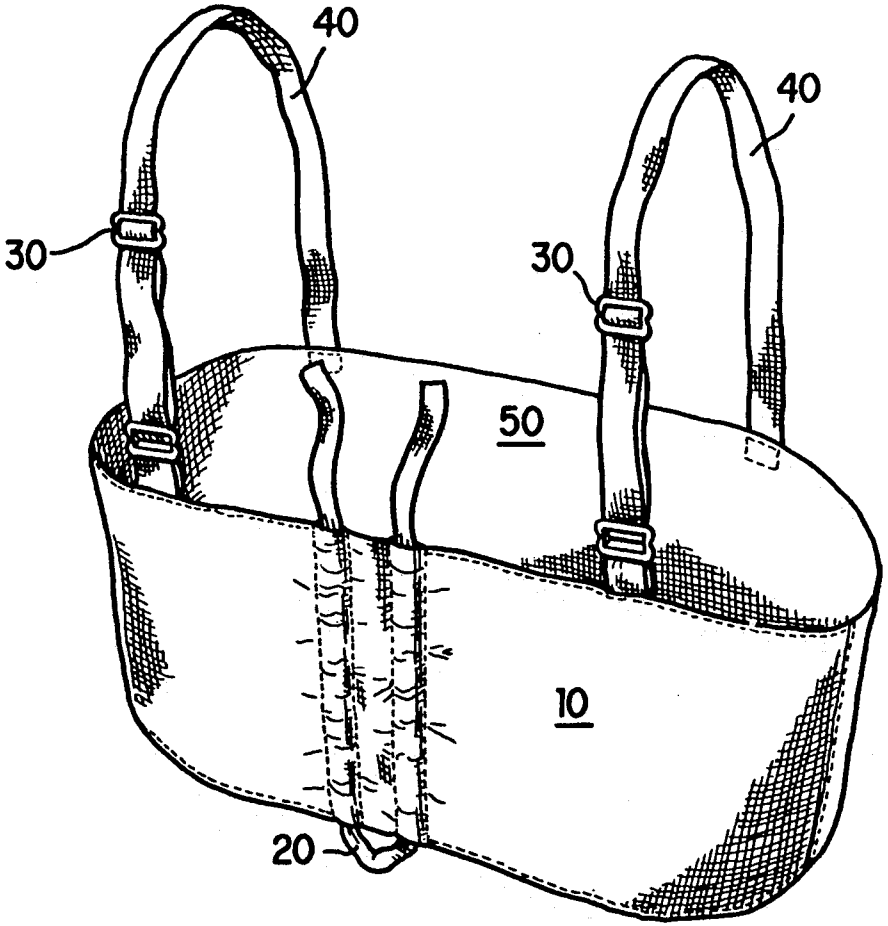
FIG. 3 is a perspective view of the bra of FIGS. 1A and 1B.

FIGS. 1A, 1B and 3 illustrate a first embodiment of the present invention. In accordance with this embodiment, the brassiere includes a front panel 10 of a non-stretch material and a back panel 50 of a stretch material. Two drawstring sleeves 23 are provided on the front panel in a central region thereof. Drawstring 20 extends through the drawstring sleeves 23 such that the two ends of the drawstring 20 extend out of the front panel 10 at the upper edge thereof.

Two straps 40 are provided. The straps 40 each have an end connected to the front panel and an end connected to the back panel. In the illustrated embodiment, the straps are in a straight configuration. However, the straps could also be provided in a crisscross pattern, as discussed below, or, eliminated entirely. Preferably, the straps are formed of a non-stretch material and include length-adjustment devices 30 for adjusting the active length of the strap 40 to the individual's preference.

As is obvious from the drawings, this version of the present invention is intended to be pulled over the head and neck in the manner of a T-shirt. As discussed below, this can present obstacles to use by persons recovering from breast surgery. On the other hand, the need to pull the bra over the wearer's head should present no problem when the bra is used as a sports bra or everyday bra; in fact, the continuous construction is normally an advantage in these uses.

Any known materials having suitable properties may be used as the stretch material and the non-stretch material. However, it is believed that particularly good results are achieved by using a 50 percent cotton/50 percent polyester blend as the non-stretch material and an 85 percent nylon/15 percent lycra blend material as the stretch material.

The drawstring sleeves 23 could be provided in any known manner, such as by providing eyelets in the front panel near the opposed edges of the front panel. However, it is believed that a particular advantageous way of forming the drawstring sleeves is by stitching adjacent pieces of non-stretch material together along two lines extending between the opposed edges of the front panel, as such in FIG. 1A. This construction is convenient because the front panel is preferably constructed of a two-sheet thickness of non-stretch material for strength and appearance. If the front panel 10 is two sheets thick, then it is necessary only to provide the parallel stitching as shown in FIG. 1A and openings at the panel edges to define a drawstring sleeve.

As shown in the drawings, the front panel and the back panel are substantially the same size, i.e., they have similar heights (vertical dimension in the drawings) and widths (horizontal dimension in the drawings). Consequently, the panels are connected along their entire ends; this increases the ease of manufacture and also results in application of uniform pressure across the non-stretch front panel by virtue of the stretching of the back panel 50. Nonetheless, it is possible to use a back panel which is significantly shorter than the front panel, or to make one of the panels significantly wider than the other panel so as to alter the ratio of stretch to non-stretch material, such that, for example, the non-stretch material could be designed to wrap partially around the user's back; of course, this would also affect the feel of the bra.

Figure 2:
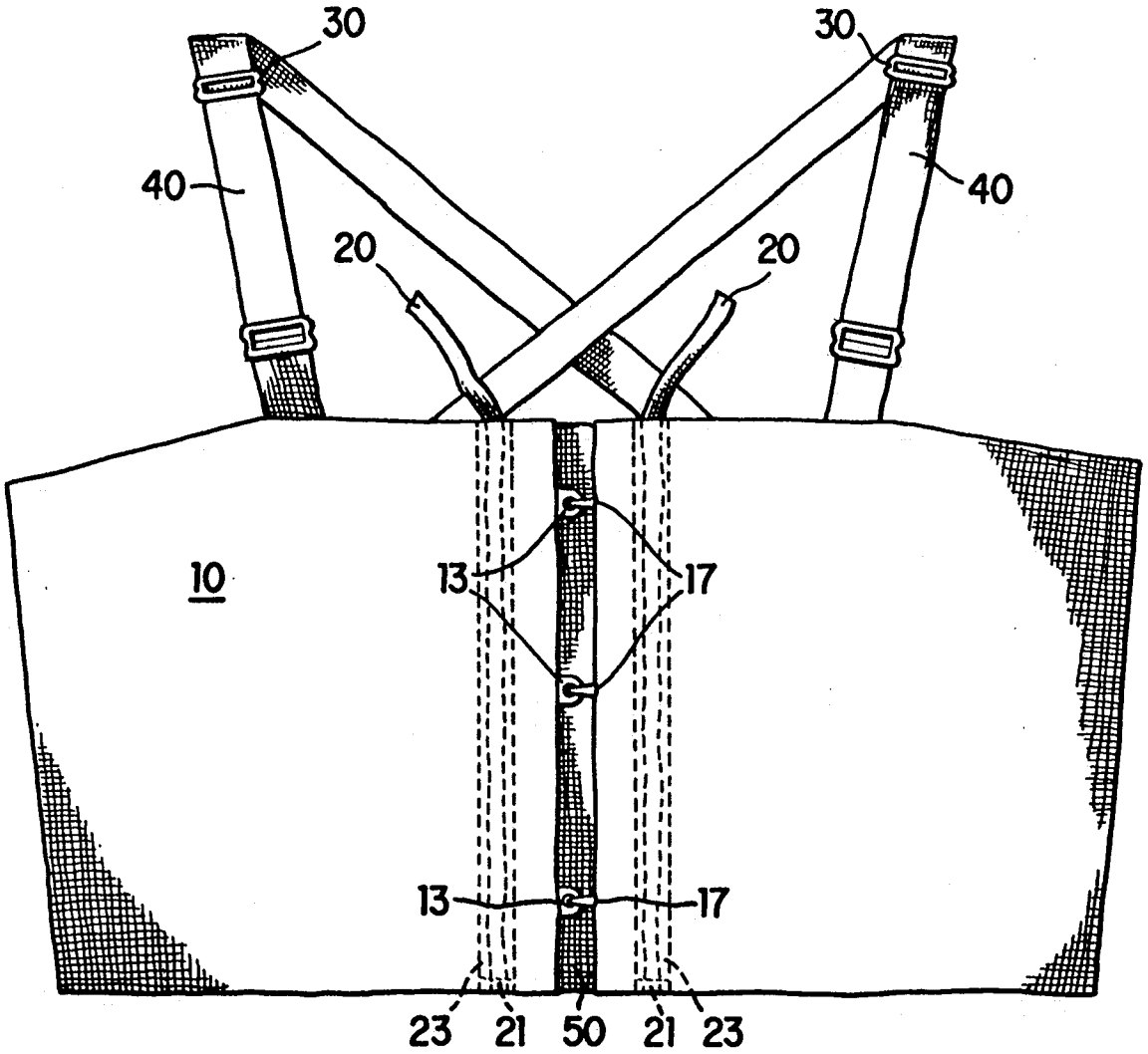
FIG. 2 is a front view of a second embodiment of the bra of the present invention.

FIG. 2 illustrates a modified embodiment of the present invention. As can be seen, the embodiment of FIG. 2 is quite similar to that previously described. One difference is that crisscross straps 40 are used as suggested above. Another difference is that the front panel 10 is divided into two portions, 10A and 10B. The two portions 10A and 10B are fastened together through the use of a fastening means. In the illustrated embodiment, a hook 17 and eye 13 fastener is employed. However, any known fastener such as button and snaps or strips of nylon fabric that can be fastened to itself, such as that sold under the trademark "VELCRO", can be used, as discussed below.

The embodiment of FIG. 2 also includes separate drawstrings 20 provided in a drawstring sleeve 23 on each of the two portions 10A and 10B of the front panel. The drawstrings 20 have one end extending out of one end of the front panel 10 and a second end attached, as at 21, near the opposed end of the front panel 10. Of course, it is possible to divide the back panel rather than the front panel, if desired. However, this would normally not be desirable because the back panel is less accessible than the front panel and because the back panel is constructed of stretch material which would work against some forms of fastening means.

Figure 4:
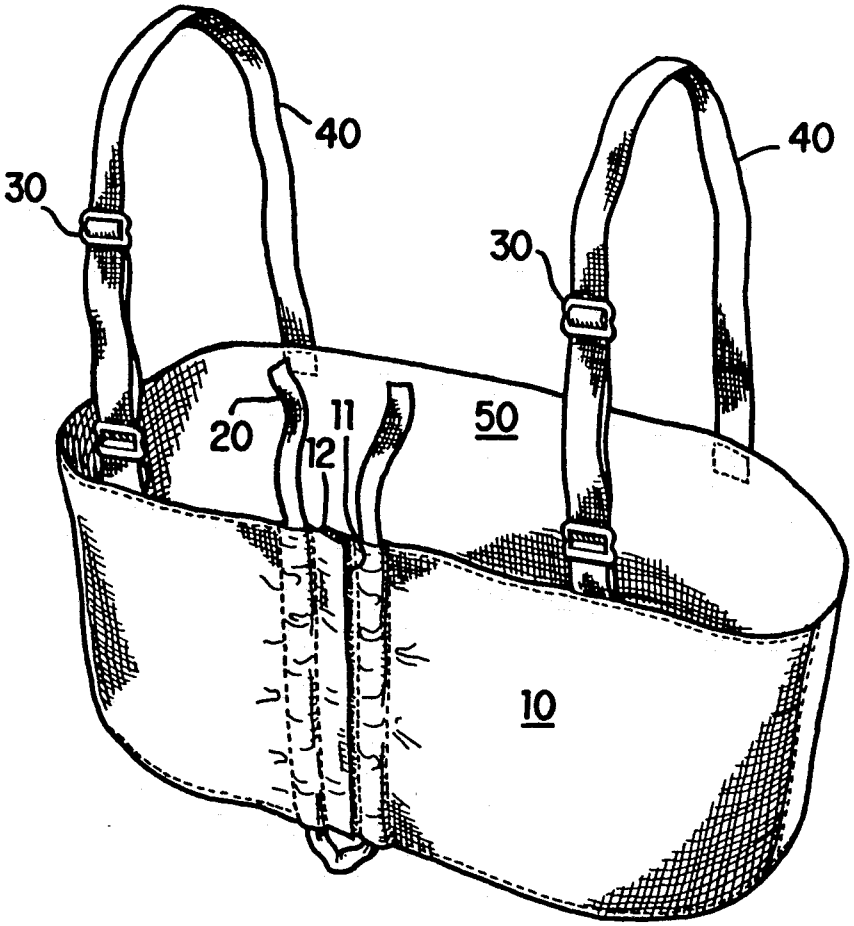
FIG. 4 is a perspective view of another embodiment of the bra of the present invention.

A bra having a divided panel, such as that shown in FIGS. 2 and 4 would normally not be used if the primary purpose of the bra was a sports bra. On the other hand, this embodiment is particularly useful as a bra for postsurgical rehabilitation. In such cases, the patient often has only restricted movement of their arms, e.g., patients might be told not to raise their arms above their head, such that pulling the bra over their head and arms would be difficult. The bra of FIG. 2 (and that of FIGS. 4 and 5) can be put on without raising the arms above the head.

Figure 5:
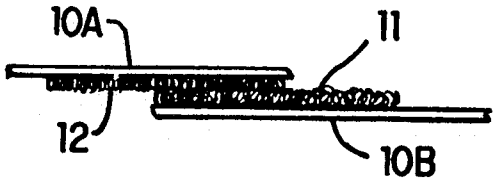
FIG. 5 is a detail view of the bra of FIG. 4.

A further embodiment, similar to the embodiment of FIG. 2, is shown in FIGS. 4 and 5. This embodiment includes straight straps 40 and a front panel 10 which is divided into portions 10A and 10B. In this embodiment, the adjacent edges of the panel portions 10A and 10B are provided with strips of nylon fabric that can be fastened to itself (of the type sold under the trademark "VELCRO") The portions 10A and 10B can be fastened to one another by simply pressing the velcro strips together in the known manner. The strips are indicated by reference numerals 11 and 12.

The brassiere of the present invention offers a number of advantages over known brassieres. For example, because the front panel is formed of a non-stretch material, such as a cotton/polyester blend, it can be imprinted with a wide variety of colors and prints so as to function as an attractive and a fashionable piece which can be worn as a top for any occasion. Moreover, the non-stretch fabric covering the breast and rib area is comfortable, lightweight and quick-drying. There are no underwires, hook-and-eyes or buttons to rub or chafe the skin during sports activities. The stretch fabric used in the back panel expands with body movements and allows for complete breathability, which is an important factor in comfort during exercising. The non-stretch material used in the front panel is durable and absorbs perspiration well. Moreover, by virtue of the construction of the present invention, the front panel is adapted to mold and hold the breasts for maximum support. Further, because of the provision of the drawstring, the individual is able to adjust the drawstring to her individual comfort and needs by tightening the drawstring.

I claim:

1. A brassiere comprising:

a substantially rectangular front panel constructed of non-stretch material, the front panel having opposed side ends;

a substantially rectangular continuous back panel constructed of stretch material, the back panel having opposed side ends, each said side end being connected to a side end of the front panel;

at least one drawstring provided in the front panel such that two drawstring ends extend out of the front panel at one edge thereof;

whereby when the drawstring ends are pulled away from the front panel, the front panel tightens; and wherein the drawstring ends and the at least one drawstring are located in an area of the front panel which is substantially equidistant from the opposed side ends.

2. The brassiere of claim further comprising two straps, each strap having a first end connected to the front panel and a second end connected to the back panel.

3. The brassiere of claim 2, wherein the straps are formed of non-stretch materials and a length-adjustment device is provided on each strap.

4. The brassiere of claim 1, wherein the front panel has a predetermined width and the back panel has a predetermined non-stretch width which is substantially equal to the width of the front panel.

5. The brassiere of claim 1, wherein the front panel has a predetermined height and the back panel has a predetermined height which is at least 70 percent of the predetermined height of the front panel.

6. The brassiere of claim 5, wherein the height of the back panel is substantially equal to the height of the front panel.

7. The brassiere of claim, wherein the front panel is divided into two portions and includes a fastener for releasibly connecting the two portions.

8. The brassier of claim 7, wherein the fastener comprises a plurality of hook-and-eye connectors.

9. The brassiere of claim 7, wherein the fastener comprises a strip of nylon fabric that can be fastened to itself provided on each of the portions.

10. The brassiere of claim 7, wherein the fastener comprises buttons and snaps provided on the portions.

11. The brassiere of claim 1, wherein the drawstring ends are part of separate drawstrings and each drawstring has another end which is secured to the front panel.

12. The brassiere of claim 1, wherein a single drawstring is provided and the drawstring ends constitute the opposed ends of the single drawstring.

13. The brassiere of claim 1, wherein the substantially rectangular front panel has angled corners.

14. A brassiere, the brassiere comprising:

a substantially rectangular front panel of non-stretch material, the front panel having opposed side ends and two edges extending between the opposed side ends;

a substantially rectangular back panel of stretch material, the back panel having opposed side ends, each said side end being connected to a side end of the front panel;

at least two drawstring sleeves provided on the front panel, the drawstring sleeves extending substantially from one edge of the front panel to the other edge of the front panel and the drawstring sleeves being located in a region of the front panel which is substantially equidistant from the opposed side ends of the front panel; and at least one drawstring provided in the drawstring sleeves such that a drawstring end extends out of each of the drawstring sleeves proximate an edge of the front panel.

15. The brassiere of claim 14, wherein one of the front panel and the back panel is divided into two portions and the other one of the front panel and back panel is continuous; and further comprising fastening means for releasibly connecting the two portions of the panel which is divided into two portions.

16. The brassiere of claim 14, further comprising two drawstrings, each drawstring being provided in one of the drawstring sleeves, each drawstring having an end connected to the front panel proximate one edge of the front panel and a second end extending out of the front panel proximate the other edge of the front panel.

17. The brassiere of claim 14, wherein the substantially rectangular front panel has angled edges including corners angled to meet the corners of the back panel.

18. A brassiere, the brassiere comprising:

a substantially rectangular front panel constructed of a material containing cotton, the front panel having opposed side ends and two substantially straight edges extending between the opposed side edges;

a substantially rectangular back panel constructed of a stretchable material, the back panel having opposed side ends, each said side end being connected to a side end of the front panel along substantially the entire side end;

at least two drawstring sleeves centrally provided on the front panel, the drawstring sleeves extending substantially from the top edge of the front panel to the bottom edge of the front panel;

at least one drawstring provided in the drawstring sleeves the drawstring having two ends and being provided such that a drawstring end extends out of each of the drawstring sleeves proximate an edge o the front panel.

19. The brassiere of claim 18, wherein the front and back panels are of substantially the same size.

20. The brassiere of claim 18, wherein the substantially rectangular front panel is tapered to meet the corners of the back panel.

* * * * *